US005697039A

United States Patent [19]

Nishimori et al.

[11] Patent Number: 5,697,039

[45] Date of Patent: Dec. 9, 1997

[54] COPYING APPARATUS

[75] Inventors: Kadotaro Nishimori; Masazumi Ito; Kimihiko Higashio, all of Osaka, Japan

[73] Assignee: Minolta Co., Ltd., Osaka, Japan

[21] Appl. No.: 819,596

[22] Filed: Jan. 9, 1992

Related U.S. Application Data

[63] Continuation of Ser. No. 486,313, Feb. 27, 1990, abandoned.

[30] Foreign Application Priority Data

Feb. 28, 1989 [JP] Japan ..... 1-48955

[51] Int. Cl.[6] ..... G03G 21/00

[52] U.S. Cl. ..... 399/368; 399/16; 399/410

[58] Field of Search ..... 355/208, 314, 355/324, 309; 271/288; 270/37, 53; 399/16, 410, 368

[56] References Cited

U.S. PATENT DOCUMENTS

| | | | |
|---|---|---|---|
| 4,248,525 | 2/1981 | Sterrett | 355/323 |
| 4,523,750 | 6/1985 | Hubler | 355/324 X |
| 4,669,719 | 6/1987 | Fratangelo | 271/251 |
| 4,727,401 | 2/1988 | Partilla et al. | 355/319 |
| 4,731,637 | 3/1988 | Acquaviva et al. | 355/317 |
| 4,751,550 | 6/1988 | Murakami | 271/288 X |
| 4,811,048 | 3/1989 | Ishikawa et al. | 355/324 X |
| 4,814,822 | 3/1989 | Acquaviva et al. . | |
| 4,864,350 | 9/1989 | Ishiguro et al. | 355/314 X |
| 4,893,152 | 1/1990 | Ishiguro et al. | 355/324 X |
| 4,905,054 | 2/1990 | Rood | 355/324 |
| 4,946,153 | 8/1990 | Kinoshita et al. | 270/53 |
| 4,994,865 | 2/1991 | Nishimori et al. | 355/324 |
| 5,006,904 | 4/1991 | Mattsuo et al. | 355/208 X |
| 5,010,371 | 4/1991 | Matsuo et al. | 355/208 X |

FOREIGN PATENT DOCUMENTS

| | | | |
|---|---|---|---|
| 0205466 | 10/1985 | Japan | 355/324 |
| 0289864 | 12/1987 | Japan | 355/324 |

*Primary Examiner*—Nestor R. Ramirez

*Attorney, Agent, or Firm*—Burns, Doane, Swecker & Mathis, LLP

[57] ABSTRACT

A copying machine having an original feeding unit for feeding originals onto a platen glass which is operable in a two-original feeding mode where two originals are placed side by side in a particular position on the platen glass, and a sheet handling unit which is operable in a binding mode where copy sheets which copied images are bound. When the two-original feeding mode is selected, a selection of the binding mode is inhibited. When the two-original feeding mode is selected after the binding mode was selected, a warning is generated to inform that the sheet handling unit becomes impossible to be operated in the binding mode. When a copying operation is started without in spite of the generation of the warning, the binding mode is canceled.

3 Claims, 8 Drawing Sheets

COPYING APPARATUS

This application is a continuation of application Ser. No. 07/486,313, filed Feb. 27, 1990 now abandoned.

BACKGROUND OF THE INVENTION

1. Field of the Invention

The present invention relates to a copying apparatus, and more particularly to a control system for a copying machine provided with an automatic document feeding unit and a copy sheet handling unit with a sheet binding function.

2. Description of Related Art

Recently, responding to the increasing demand for automatic handling systems of original documents and copy sheets, a variety of automatic document feeders (referred to as "ADF" hereinafter) in which original documents in a stack are successively fed onto a platen glass and then subjected to an image scanning operation to be thereafter ejected from the platen glass, and a variety of copy sheet handling units (referred to as "finisher" hereinafter) in which copy sheets ejected from the copying machine are stapled by means of an electric stapler, etc. have been developed.

In this type of finisher, copy sheets are stapled at a fixed place, and therefore the sheets which can be processed are ordinarily restricted to the A4-sized sheets, B5-sized sheets and sheets of 8½ inches by 11 inches being fed latitudinally (in a state that each sheet is fed with its shorter side parallel with the feeding direction). On the other hand, Japanese Patent Laid Open Publication No. 63-280266 discloses an ADF having a two-original feeding mode in which originals in a stack are continuously fed onto the platen glass in pairs. In the two-original feeding mode, originals are ordinarily fed latitudinally, during which the image scanning is performed in the same manner as in a case that originals of double the size are fed longitudinally (in a state that each sheet is fed with its longer side parallel with the feeding direction). Therefore, copy sheets which are double the size of originals and are set in feed section to be fed longitudinally are selected to be supplied.

When both the above-mentioned ADF and finisher are mounted to a copying machine, there occurs such a problem that the two-original feeding mode and the copy sheet stapling mode are incompatible. Copy sheets are fed longitudinally in the two-original feeding mode, while the finisher is designed to-cope with copy sheets being fed latitudinally, so that longitudinally fed copy sheets cannot be subjected to the stapling process.

SUMMARY OF THE INVENTION

Accordingly, it is an object of the present invention to provide a copying apparatus wherein mode selection is controlled in consideration of operators' convenience with regard to the two-original feeding mode and the copy sheet binding mode which are incompatible.

In order to achieve the above object, a copying apparatus according to the present invention comprises original feeding means which is capable of operating in a plurality of original feeding modes; image copying means for copying on a copy sheet the image of the original on the platen glass; sheet handling means which is capable of operating in a plurality of modes for handling copy sheets which have copied an image by the image copying means; selection means for selecting an operation mode of the original feeding means and an operation mode of the sheet handling means; and control means for automatically selecting an operation mode of the sheet handling means in accordance with a selected mode of the original feeding means. The original feeding means is capable of operating either in a two-original feeding mode where two originals are placed in a particular position on the platen glass side by side or in a one-original feeding mode where one original is placed in a particular position on the platen glass. The sheet handling means is capable of operating either in a binding mode where copy sheets are collected and bound or in a non-binding mode where copy sheets are stacked without bound.

The control means is capable of operating in at least one of the following three control conditions, (1), (2), and (3).

(1) When the two-original feeding mode is selected, no selection of the binding mode is permitted. In the two-original feeding mode, copy sheets to be fed longitudinally are used in disregard of the magnification ratio in an image copying, and no processing in the binding mode is permitted. Therefore, when the two-original feeding mode is selected first, no subsequent input of the binding mode is received, which also eliminates possible erroneous input by an operator or obviates releasing the binding mode.

(2) When the two-original feeding mode is selected in the condition where the binding mode is selected, a warning sign indicating that no operation in the binding mode is permitted is displayed. When the binding mode is selected first, subsequent selection of the two-original feeding mode is permitted. However, since no simultaneous operation of the two modes is possible, priority is given to the two-original feeding mode by displaying the warning sign indicating that no operation in the binding mode is permitted. The warning sign is displayed, for example, in the form of flickering the mode selection lamp composed of an LED. The warning sign urges an operator to reconsider the mode selection between a selection of releasing either one of the two modes and a selection of totally resetting the modes, which leads to preventing possible erroneous copy operation.

(3) When an image copying operation is carried out in disregard of the above-mentioned warning sign processed through the above control operation (2), the binding mode is canceled. An image copying operation starts ordinarily in response to an input through turning on a print key switch, and after the binding mode is canceled, an image copying operation is performed in the two-original feeding mode.

In each of the above-mentioned control conditions, a priority is given to the two-original feeding mode. The above arrangement is adopted for the reason that the binding operation can be easily performed manually after the image copying operation, in contrast to the fact that the two-original feeding operation cannot be easily performed manually without the original feeding means.

BRIEF DESCRIPTION OF THE DRAWINGS

These and other objects and features of the present invention will become apparent from the following description taken in conjunction with the preferred embodiment thereof with reference to the accompanying drawings.

DETAILED DESCRIPTION OF THE PREFERRED EMBODIMENT

The following describes the construction and operations of a copying apparatus in accordance with the present invention with reference to the attached drawings.

Figure 1:
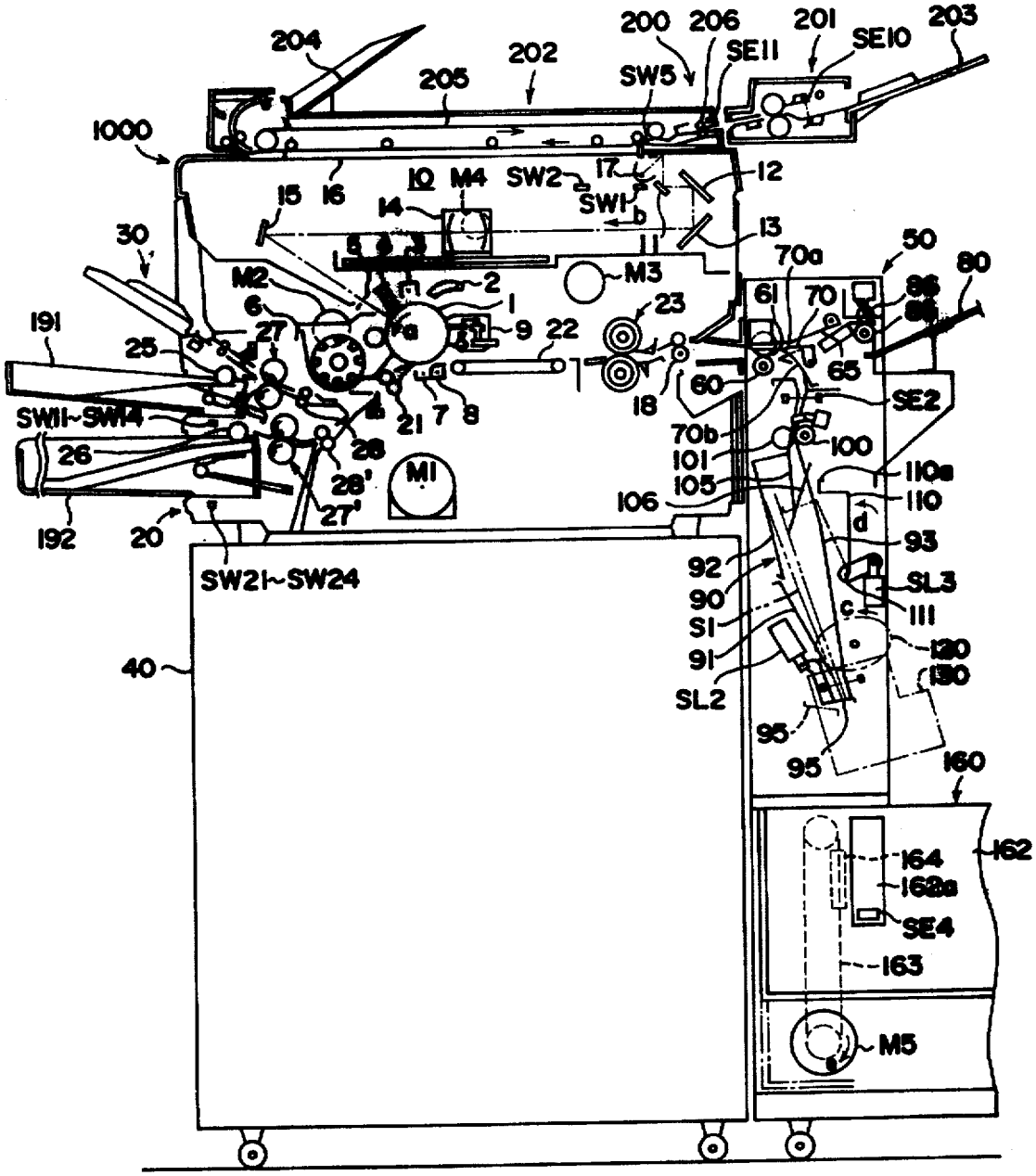
FIG. 1 is a schematic view of a copying apparatus showing the constitution.

[Constitution and Operation of the Copying Machine: Refer to FIG. 1]

A copying machine 1000 is mounted on a desk 40. Approximately in the center of the copying machine 1000, a photosensitive drum 1 is so disposed that it is capable of rotating in the direction of the arrow (a). Around the photosensitive drum 1, an eraser lamp 2, an electrostatic charger 3, an image side/interval eraser 4, a magnetic brush type developing unit 6, an image transfer charger 7, a sheet separating charger 8, a cleaning unit 9 with a blade are arranged in order. The photosensitive drum 1 is eliminated of the electrostatic charge while passing the eraser lamp 2, and the surface is electrified uniformly while passing the electrostatic charger 3. Then, the surface of the photosensitive drum 1 is exposed to a light from an optical system 10 via a slit 5 to form a corresponding electrostatic latent image thereon. The image side/interval eraser 4 has a plurality of light-emitting diodes arranged in the widthwise direction of the image to eliminate unnecessary electrostatic charge from the surface of the photosensitive drum 1 at the time of image formation.

The optical system 10, which is disposed below a platen glass 16 to scan an original image and expose the photosensitive drum 1, comprises a lamp 17, movable mirrors 11, 12 and 13, a lens 14 and a mirror 15. The lamp 17 and the movable mirror 11 are driven by a motor M3 to move in one body in the direction of the arrow (b) at a speed of v/m (v: peripheral speed of the photosensitive drum 1, m: magnification ratio) The speed v is constant without regard to the magnification ratio. The movable mirrors 12 and 13 are driven by the motor M3 to move in one body in the direction of the arrow (b) at a speed of v/2m. The optical system 10 is provided with switches SW1 and SW2 for detecting the position of the optical system 10. The position switch SW1 is for detecting whether or not the optical system 10 stands by at the scanning start position. The timing switch SW2 is for obtaining a reference signal for feeding a copy sheet to the image transfer section.

In order to change the magnification ratio, the lens 14 is moved along the optical axis and the mirror 15 is moved and swung to adjust the optical path by means of a stepping motor M4. Such a mechanism of changing the magnification ratio is well-known. Also, with regard to control of the scanning speed of the optical system 10, the rotating speed of the motor M3 is controlled in accordance with the magnification ratio. Detailed description of the control system is omitted here.

A copy sheet is fed into the image transfer section by way of an automatic copy sheet feed section 20 having two cassettes disposed one upon the other or by way of a manual copy sheet feed section 30 disposed above the automatic sheet feed section 20. The copy sheet is once held by timing rollers 21, and then fed into the image transfer section in synchronization with an electrostatic latent image formed on the photosensitive drum 1. In the image transfer section, the copy sheet receives a toner image by the operation of the image transfer charger 7, and then separates from the photosensitive drum 1 by the operation of AC discharge from the sheet separation charger 8. The copy sheet is transported into an image fixing unit 23 by a conveyer belt 22 so that the toner image can be fixed on the sheet. Then, the copy sheet is fed into a finisher unit 50 by ejection rollers 18. After the image transfer operation, the toner and electrostatic charge remaining on the photosensitive drum 1 are removed and erased by the operation of the cleaning unit 9 and the eraser 2 so that the photosensitive drum 1 can be ready for the next copying operation.

The automatic copy sheet feed section 20 and the manual copy sheet feed section 30 are selectively used. When the automatic sheet feed section 20 is selected, the image copying system including the photosensitive drum 1 starts its operation in response to turning on a print key switch 301 (refer to FIG. 2) for starting an image copying operation of the copying machine 1000. On the completion of preliminary processing of the photosensitive drum 1, a feed roller 25 or 26 is driven to supply copy sheets for the image transfer section, and the optical system 10 starts its operation in response to a scan start signal generated in conformity with the supply of copy sheets. Thus, the supply of copy sheets is synchronized with the formation of an electrostatic latent image. First, two or three copy sheets are fed by the rotation of the feed roller 25 or 26, and then the uppermost copy sheet is picked by a sheet separation mechanism 27 or 27' in the next stage to transport the uppermost sheet to the timing rollers 21 via intermediate rollers 28 or 28'. Regarding the sheet separation mechanisms 27 and 27', the upper the rollers are driven to rotate in sheet feeding direction and the lower rollers are driven in the direction reverse to the sheet feeding direction.

At the cassette receiving portion of the automatic sheet feed section 20, sheet size detection switches SW11 through SW14 and SW21 through SW24 are provided. Each of the switches changes its operation condition in accordance with the projections or magnets (not shown) provided for the cassettes 191 and 192 to discriminate the size of copy sheets stored therein, based on a signal in 4-bit binary code.

[Constitution and Operation of the ADF: Refer to FIG. 1]

An automatic document feeder 200 (which will be referred as ADF) is mounted on the copying machine 1000 so that they can cooperate in an image copying operation. The ADF 200 mainly comprises an original take-out section 201 for taking an original out of a stack; and an original conveying section 202 for conveying each original taken out of the original take-out section 201 along the surface of the platen glass 16 by means of a conveyer belt 205 to put the original in a specified position on the platen glass 16, and after an image scan, discharging the original therefrom onto a tray 204. The ADF 200 can operate either in a one-original feeding mode where original documents are fed one by one to be put in the specified position on the platen glass 16 and discharged therefrom after an image scan, or in a two-original feeding mode where original documents are fed in pairs so that two originals can be placed in a specified position on the platen glass 16 side by side and discharged therefrom after an image scan.

The original conveying section 202 can be independently used as a manual original feed unit. Since the original conveying section 202, which is attached to the copying machine 1000, can be put an open and closed states to cover and uncover the platen glass 16, it also functions as an ordinary original cover. The copying machine 1000 is provided with a magnet (not shown). When the original conveying section 202 is closed, a switch SW5 consisting of a lead switch is turned on by detecting the magnet. When the original conveying section 202 is open, the switch SW5 is turned off. While the switch SW5 is turned on, the control of the ADF 200 is linked with the control of the copying machine 1000, and the operation mode of the copying machine 1000 is changed to an ADF mode.

In the ADF mode, when the print key switch 301 (refer to FIG. 2) on the copying machine 1000 is turned on, the ADF 200 starts operating to feed an original out of an original tray 203 and place it in the specified position on the platen glass 16, while the copying machine 1000 is standing by. An image scan start signal is generated from the ADF 200 to start an image copying operation. When the last scan of the original is completed, an image scan completion signal is generated from the copying machine 1000 to discharge the original from the platen glass 16 onto the tray 204. At the same time, the next original is placed in the specified position. The existence of originals on the tray 203 is checked by means of an original sensor SE1O. While the original sensor SE1O is detecting the presence of any original, the image copying operation is continued in the ADF mode.

The ADF 200 further includes means for automatically judging the size of an original. In detail, the width of the original supplied from the original take-out section 202 is detected by a sensor group SE11 disposed at the original receiving portion of the original conveying section 202, and the duration of the detection of the original by the sensor group SE11 is measured to judge the length of the original. It is noted that a variety of means for detecting the size of an original are known, and the above-mentioned detection means with the sensor group SE11 is merely one embodiment.

In the two-original feeding mode, the following operations are performed. Regarding a first original supplied from the original tray 203, when the trailing end of the first original has passed through the register rollers 206, the conveyer belt 205 is reversed to put the trailing end of the original in the nip portion of the register rollers 206. At the same time, a second original is fed out of the original tray 203, and the leading end of the second original is put in the nip portion of the register rollers 206. Thereby, the two originals are juxtaposed in the original feeding direction. In the above condition, the register rollers 206 and the conveyer belt 205 are rotated forward to place the two originals on the platen glass 16 side by side. It is also noted that the two-original feeding operation is not limited to the above-mentioned processing.

[Constitution and Operation of the Finisher Unit: Refer to FIG. 1]

The finisher unit 50 mainly comprises rollers 60 and 61 for receiving copy sheets ejected from the copying machine 1000, a diverting member 70 for diverting the travel of copy sheets, a tray 80, sheet ejection rollers 85 and 86, transport rollers 100 and 101, and a tray 90 having a stapling mechanism. The staple tray 90 includes a base plate 91 and guide plates 92 and 93. At the lower portion of the staple tray 90, a stopper 95 driven by a solenoid SL2, a paddle wheel 120 for aligning copy sheets, and an electric stapler 130 are disposed.

The following describes the operation of the finisher unit 50.

(Non-stapling mode)

In a non-stapling mode, copy sheets ejected from the copying machine 1000 through the ejection rollers 18 are directed onto the tray 80 without being stapled and stacked thereon.

In this mode, the diverting member 70 is put in the position as indicated by the dashed line in FIG. 1, so that copy sheets received in the finisher unit 50 through the rollers 60 and 61 are guided by the upper surface 70*a* of the diverting member 70 and a guide member 65 to the ejection rollers 85 and 86 and ejected onto the tray 80.

(Stapling mode)

In a stapling mode, copy sheets received in the finisher unit 50 are collected and aligned in the staple tray 90 to be stapled by the stapler 130, and stapled sets of copy sheets are stored in a sheet stack unit 160.

In this mode, the diverting member 70 is put in the position as indicated by the solid line in FIG. 1, so that copy sheets received in the finisher unit 50 through the rollers 60 and 61 are guided by the curved surface 70*b* of the diverting member 70 and the upper portions of the guide plates 92 and 93 to the transport rollers 100 and 101 and transported into the staple tray 90. Simultaneously with the rotation of the rollers 100 and 101, the paddle wheel 120 is driven forward in the direction of the arrow (c). When a copy sheet has passed through the transport rollers 100 and 101, the sheet is provided with a transporting force by the paddle wheel 120 and moved toward a sheet regulation side to collate. The copy sheet which received the transporting force of the transport rollers 100 and 101 is directed according to the setting of the nip portion of the rollers 100 and 101, which is set so that the sheet can be directed toward the guide plate 93. Then, a flexible film 105 comes into contact with the copy sheet to stiffen the sheet, and the sheet is placed in the staple tray 90, avoiding the friction with previously stored copy sheets S1. At the same time, a static erasing brush 106 comes into contact with the copy sheet to eliminate electrostatic on the sheet. Also, the flexible film 105 and the static erasing brush 106 are in contact with the upper portion of the stored sheets S1 to prevent the sheets S1 from bending or toppling.

Incidentally, when a copy sheet is curled due to the heat of the image fixing unit 23, etc. and placed in the staple tray 90 with its upper portion curled toward the guide plate 93, the leading end of the next coming sheet will collide with the curled upper portion of the stored sheets S1, which may cause a paper jam. In order to avoid such a trouble, in this embodiment, a pressing member 110 presses the upper portion of the sheets S1 stored in the tray 90.

In detail, after a certain time from the detection of the leading end of a copy sheet by the photosensor SE2, for example, on the completion of the alignment of the sheet by the paddle wheel 120, the solenoid SL3 is turned on to pivot the sheet pressing member 110 in the direction of the arrow (d) on its support shaft 111. Then the sheet pressing member 110 protrudes its head portion 110*a* into the staple tray 90 through an opening (not shown) of the guide plate 93 to push the upper portion of the sheets S1. Thereby, the upper portion of the sheets S1 which may include any curled sheet is pressed against the bottom of the staple tray 90 (guide plate 92), and the curled portion becomes straight.

The sheet pressing member 110 pivots in the direction reverse of the arrow (d) by the turning-off of the solenoid SL3 before the leading end of the next coming copy sheet S2 reaches the sheet pressing member 110, and releases the sheets S1 from the pressure. The arrangement above prevents the sheets S1 from curing its upper portion toward the guide plate 93 and further prevents a paper jam due to the collision of the next coming sheet with the curled portion of the sheets S1.

Thus, copy sheets are transported to the staple tray 90 one by one and stored therein in order with their printed sides facing the guide plate 93. Either in response to the completion signal indicating the completion of the image copying operation of the last original in a case that the ADF 200 is in operation, or in response to a stapling request signal transmitted from a switch (not shown) which is manually operated by the operator in a case that the ADF 200 is not in operation, the stapler 130 is activated to staple the copy sheets in a stapling position (D).

When a stapling operation is completed, the solenoid SL2 is turned on to move the stopper 95 to the position as indicated by the dashed line in FIG. 1 to open the bottom of the staple tray 90. At the same time, the paddle wheel 120 rotates in the direction reverse to the arrow (c). Then, the stapled copy sheets moves downward, swayed to the rear side in FIG. 1 by the gravity and by force of the paddle wheel 120 so as to maneuver the stapled portion away from the stapling position (D), and finally the stapled copy sheets are ejected downward from the staple tray 90.

In another way, in response to a signal from the ejection switch (not shown) disposed on the operation panel (not shown) of the finisher unit 50, the solenoid SL2 can be operated to eject the copy sheets from the staple tray 90 without being stapled.

Bundles of copy sheets ejected from the staple tray 90 are stored in a stack box 162 of the sheet stack unit 160.

[Constitution and Operation of the Stack Unit: Refer to FIG. 1]

The sheet stack unit 160 is arranged so that the stack box 162 is connected through a fixture 164 to a belt 163 which is actuated by a motor M5 to rotate in the forward and reverse directions, in order to allow the upward or downward adjustment of the stack unit 160. Also, openings 162*a* are formed on both sides of the stack box 162, and a photosensor SE4 is provided at the openings 162*a* to detect the volume of copy sheets stacked in the stack box 162.

Stapled sets of copy sheets are discharged from the staple tray 90 one after another and stacked in the stack box 162. Then, when the sensor SE4 detects the top of the stack, the motor M5 is rotated in the direction of the arrow (d), and the stack box 162 is moved downward in accordance with the rotation of the belt 163. As the stack box 162 is moved downward, the photosensor SE4 is released from the interruption of its optical axis by the sheet stack and turned off. Then, the motor M5 is turned off. Therefore, every set of copy sheets falls at a constant distance into the stack box 162.

Figure 2:
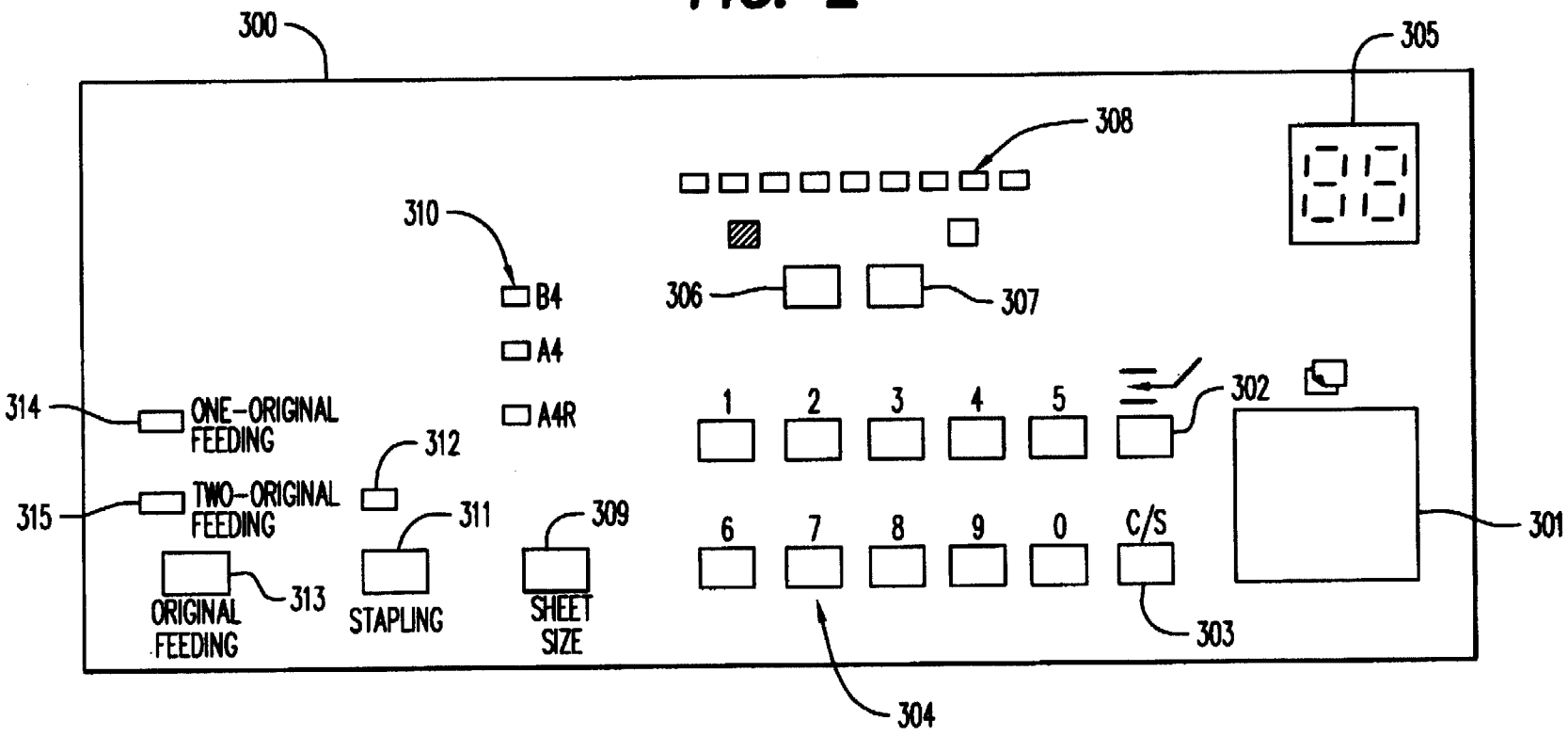
FIG. 2 is a plan view of an operation panel.

[Operation Panel: Refer to FIG. 2]

An operation panel 300 is mounted on the copying machine 1000 at the upper front and includes a print key 301 for starting an image copying operation, an interruption key 302 for performing an interruption image copying operation, a clear/stop key 303 for stopping a multiple copying operation or canceling the set number, ten keys 304 for setting numbers such as the number of copies, a display 305 for displaying the number of copies or the condition of the copying machine 1000, an up and a down keys 306 and 307 for setting the copying density, density display LEDs 308, a sheet size selection key 309, sheet size display LEDs 310, a stapling mode selection key 311, an LED 312 for indicating that the stapling mode is selected, a selection key 313 for selecting the ADF original feeding mode (one-original feeding mode or two-original feeding mode), a one-original feeding mode indication LED 314, a two-original feeding mode indication LED 315, etc.

[Relationship Between the Stapling Mode and the Two-original Feeding Mode]

The stapling mode is selected when the key switch 311 is turned on once, and the LED 312 is lighted, and the mode is canceled when the key switch 311 is turned on once more, and the LED 312 is turned off. With regard to the original feeding mode, the one-original feeding mode is initially set, and the LED 314 is on. Then, when the key switch 313 is turned on once, the original feeding mode is changed to the two-original feeding mode, and the LEDs 314 and 315 are turned off and on respectively. Thus, each time the key switch 313 is turned on, the original feeding mode is changed to the one-original feeding mode and the two-original feeding mode alternatively.

In this embodiment, the finisher unit 50 is so designed that a stapling operation is available only for latitudinally fed A4-sized copy sheets and B5-sized copy sheets. When the two-original feeding mode is selected as an operation of the ADF 200, copy sheets of an appropriate size are fed longitudinally (the sheet size depends on the magnification ratio), and in this case, a stapling operation is not available. However, an operator may select the stapling mode and the two-original feeding mode, which are incompatible with each other, for an operation by mistake.

To prevent such an erroneous operation, in this embodiment, the two-original feeding mode has priority over the stapling mode. Once the two-original feeding mode is selected, no selection of the stapling operation is permitted. When the two-original feeding mode is selected after the stapling mode was selected, the LED 312 flickers to warn the operator not to select the stapling mode. When the print key switch 301 is turned on without regard to the warning, the stapling mode is automatically canceled, and the copying operation is performed in the two-original feeding mode. The actual control procedures of the operation will be described later, referring to flowcharts.

Figure 3:
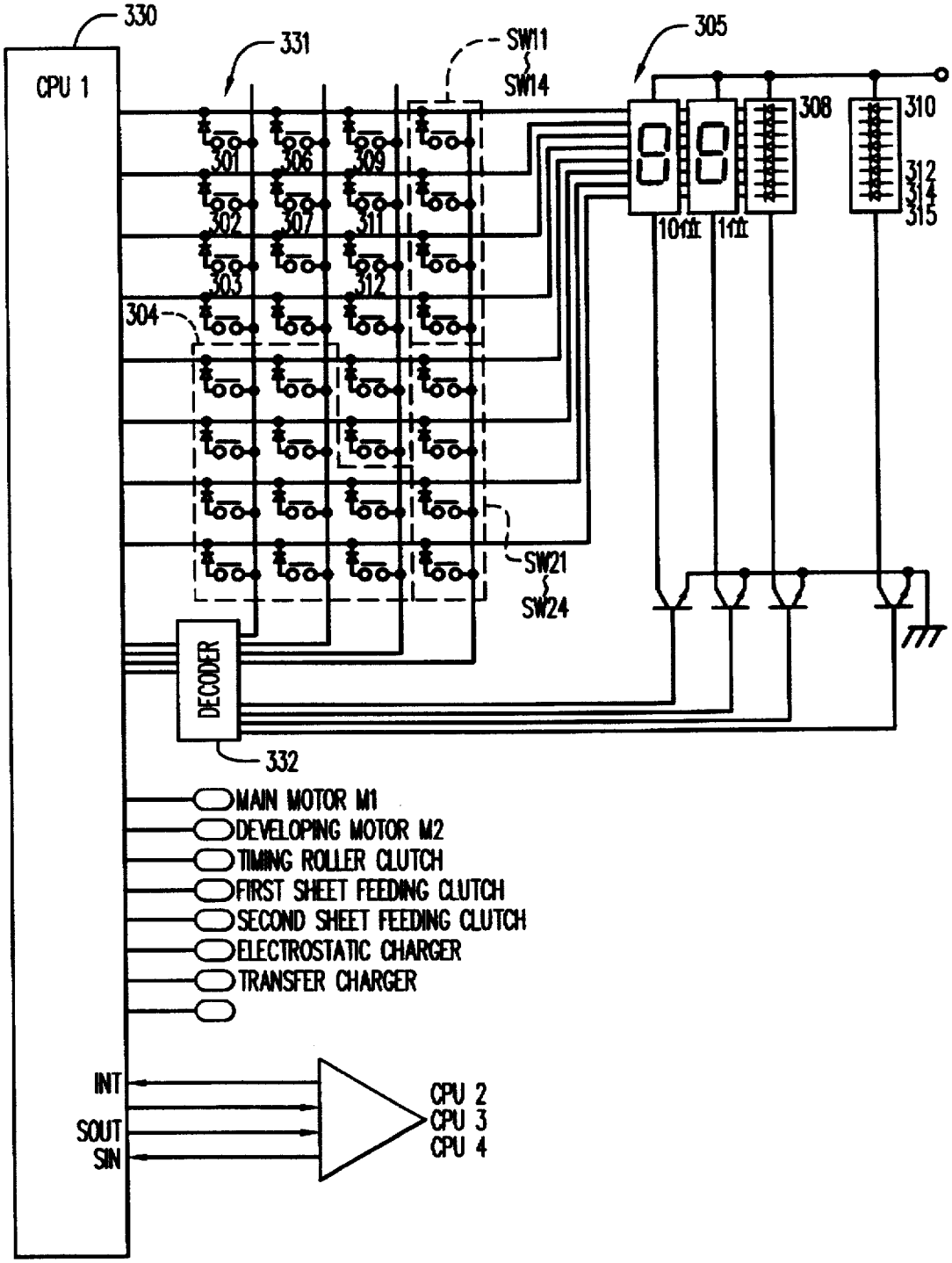
FIGS. 3 and 4 are block diagrams showing a control circuitry.
Figure 4:
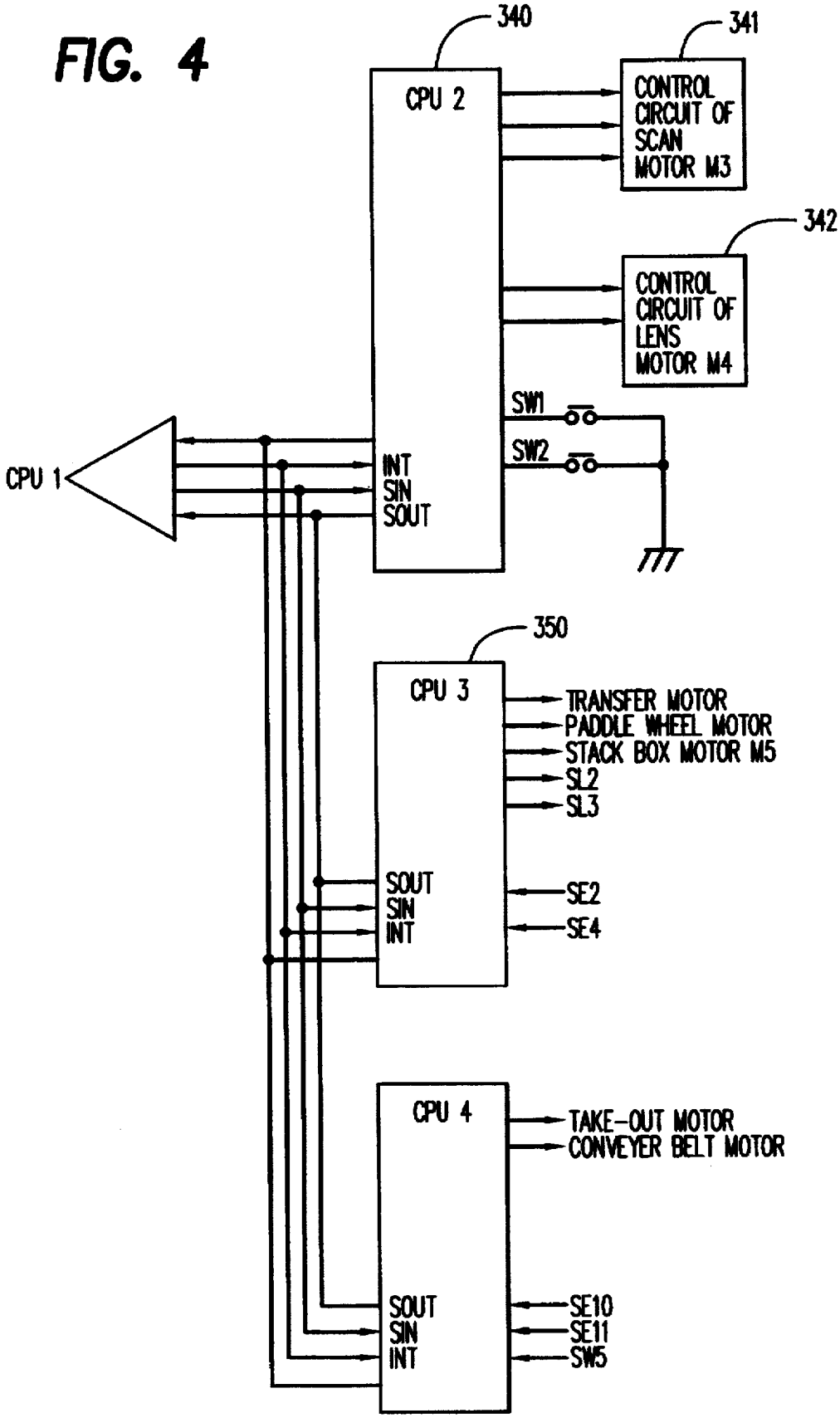

[Control Circuitry: Refer to FIGS. 3 and 4]

The control circuitry of the copying apparatus is mainly composed of a first CPU 330 for controlling the copying machine 1000, a second CPU 340 for controlling the optical system 10, a third CPU 350 for controlling the finisher unit 50, and a fourth CPU 360 for controlling the ADF 200. A switch matrix 150 including built-in switches of the keys on the operation panel 300, the display 305, the indication LEDs 314 and 315, etc. are connected to the first CPU 330 via a decoder. The output ports of the first CPU 330 lead to the main motor M1 of the copying machine 1000, a motor for an image development, a timing roller clutch, a sheet feeding clutches, etc. A control circuit 341 of the scan motor M3, a control circuit 342 of the lens motor M4 and the switches SW1 and SW2 etc. are connected to the second CPU 340. A motor of the transport system in the finisher unit 50, a motor of the paddle wheel 120, the motor M5 of the stack box 162, the solenoids SL2 and SL3, etc. are connected to the third CPU 350, and signals from the sensors SE2, SE4 etc. are input to the third CPU 350. A motor of the original take-out section 201, a motor of the conveyer belt 205, etc. are connected to the fourth CPU 360, and signals from the sensors SE10, SE11, the switch SW5, etc. are input to the fourth CPU 360.

The CPU 330 exchanges data with the other CPUs 340, 350 and 360 to designate the control operations for each of the CPUs 340, 350 and 360. The CPU 330 includes a built-in RAM which stores data necessary for carrying out the program as described later. The data are transmitted to the other CPUs.

[Control Procedures: Refer to FIGS. 5 through 11]

Procedures of controlling the copying apparatus with the constitution and the control circuitry described above are hereinafter explained. In the following paragraphs, the term "on-edge" is defined as a change in state that a switch, a sensor, a signal or the like is changed from off to on, and the term "off-edge" is defined as a change in state that a switch, a sensor, a signal or the like is changed from on to off.

Figure 5:
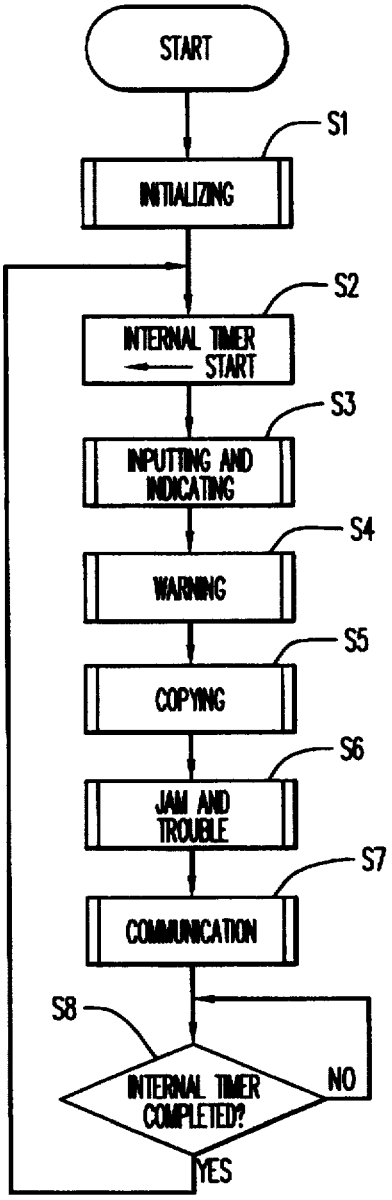
FIG. 5 is a flowchart showing a main routine of a microcomputer controlling a copying machine.

FIG. 5 shows a main routine of the first CPU 330.

When the CPU 330 is reset to start the program, initial setting for clearing the RAM, initializing each register, and putting each unit into the initial mode is carried out at step S1. Then an internal timer of the CPU 330 starts at step S2. The internal timer is for determining the time necessary for performing the main routine, where the time value is preliminarily set at the initializing step.

Then subroutines at steps S3 through S6 are successively called, and data communication between the CPU 330 and the CPUs 340, 350 and 360 is performed at step S7. Further at step S8, after the internal timer runs out, one routine is completed. The time for carrying out the one routine is utilized for counting each timer in each subroutine. In each subroutine, whether the corresponding timer runs out is judged by counting the above-mentioned one routine by certain times.

Step S3 is a subroutine at which a variety of commands are received from the key switches on the operation panel 300 with the lighting of the corresponding indicators. The principle concrete procedures of the step are described in detail with reference to FIGS. 6, 8 and 9.

Figure 7:
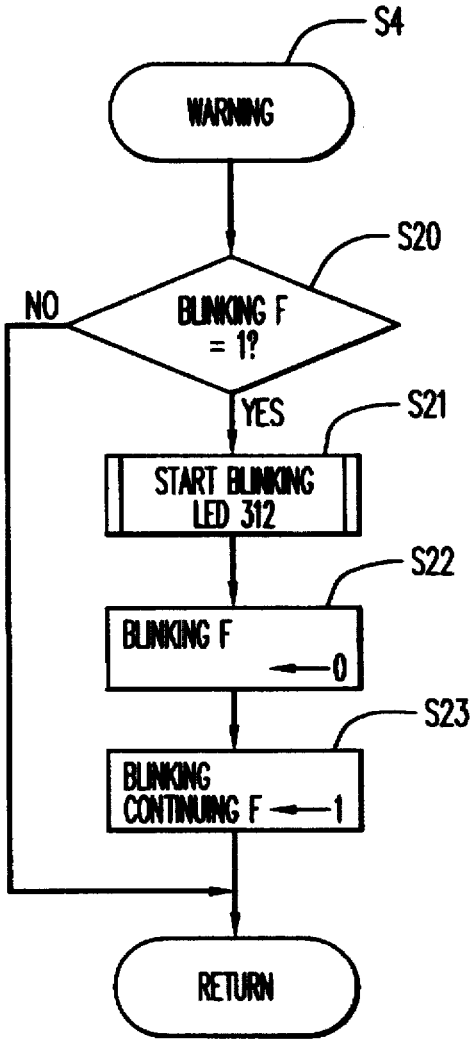
FIG. 7 is a flowchart showing a subroutine for generating a warning.

Step S4 is a subroutine at which, when an inappropriate mode is selected, a warning is indicated for the operator, which is discussed in detail in reference to FIG. 7.

Step S5 is a subroutine for performing an image copying operation with the copying machine 1000, while Step S6 is a subroutine for detecting a paper jam, etc. and performing necessary operation for indicating a warning. The operations in Steps S5 and S6 are so well-known that the detailed description is not provided here.

Figure 6:
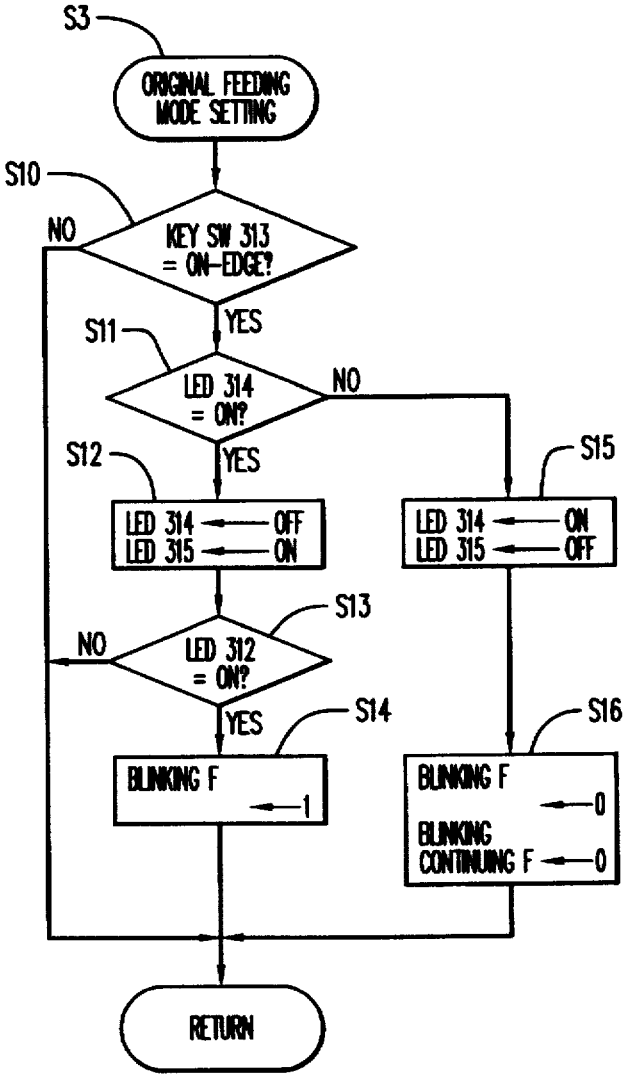
FIG. 6 is a flowchart showing a subroutine for selecting an original feeding mode.

FIG. 6 shows a subroutine for setting the original feeding mode, which is performed at step S3.

First, it is judged whether the mode selection key switch 313 is on-edge at Step S10. When it is not on-edge, this subroutine is completed immediately. When the key switch 313 is on-edge, the processing goes to step S11. At Step S11, it is judged whether the LED 314 is on, that is, whether the one-original feeding mode is currently set. When the LED 314 is on, the LED 314 is turned off at step S12 and the LED 315 is turned on to switch the one-original feeding mode to the two-original feeding mode. Then the processing goes to step S13, at which it is judged whether the LED 312 is on, that is, whether the stapling mode is currently set. Copy sheets are fed longitudinally in the two-original feeding mode, wherein the stapling operation is not available. For the reason, when the LED 312 is on, a blinking flag is set to "1" at step S14 to prepare for blinking the LED 312 and indicating a warning, and then this subroutine is completed.

On the other hand, when it is judged at step S11 that the LED 314 is off, which means that the two-original feeding mode is currently set, the LED 314 is turned on and the LED 315 is turned off at step S15 to switch the two-original feeding mode to the one-original feeding mode. Since in the one-original feeding mode, it is unnecessary to blink the LED 312 as a warning, the blinking flag and a blinking continuing flag for designating the continuous blinking of the LED 312 are reset to "0" at step S16, and this subroutine is completed.

FIG. 7 shows a subroutine for generating a warning in a case where a selection of the stapling mode is inappropriate.

First, it is judged at step S20 whether the blinking flag is "1". When the flag is "0", this subroutine is completed. The blinking flag is set to "1" when the two-original feeding mode is selected in a state that the stapling mode is set (refer to step S14). Therefore, when the flag is "1", the LED 312 is started blinking at step S21 and the blinking flag is reset to "0" at Step S22. Then the blinking continuing flag is set to "1" and the continuous LED blinking is designated at step S23, and this subroutine is completed.

Figure 8:
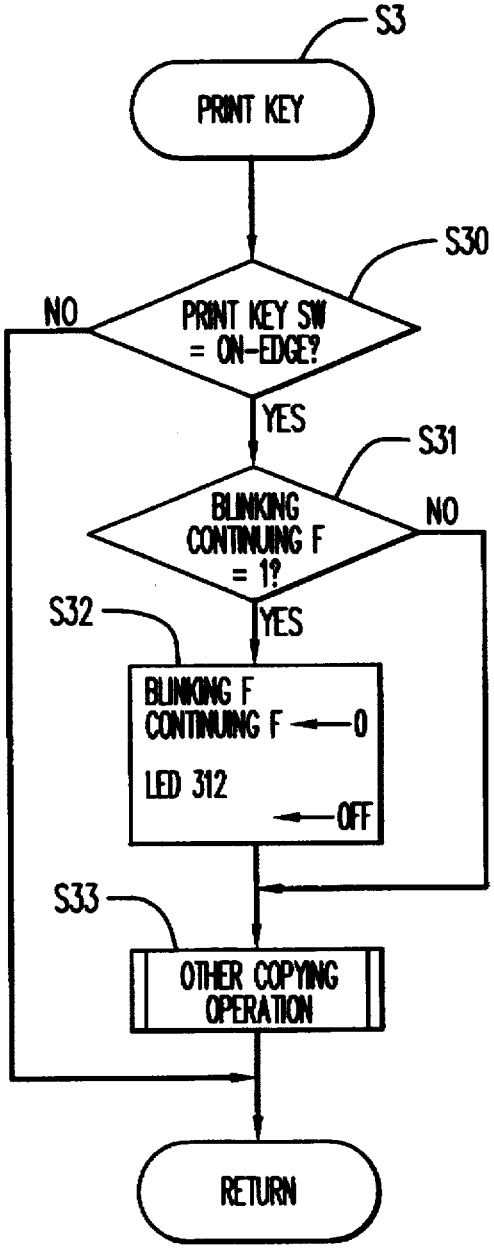
FIG. 8 is a flowchart showing a subroutine to be executed at the time of turning on a print key switch.

FIG. 8 shows a subroutine for a case where the print key switch 301 is turned on. The subroutine is performed only when the print key switch 301 is turned on.

When it is judged at step S30 that the print key switch 301 is on-edge, it is then judged at step S31 whether the blinking continuing flag is "1". The flag is, as mentioned above, set to "1" when the two-original feeding mode is selected together with the stapling mode (refer to step S23). When the flag is "0", the processing goes to step S33 to perform the other processing to start an image copying operation. When the flag is "1", a warning of an inappropriate selection of the stapling mode is presently indicated. If the operator gives a command to start a copying operation without regard to the warning, the blinking continuing flag is reset to "0" at step S32, and the LED 312 is turned off, that is, the stapling mode is canceled. Thereafter, the processing goes to step S33, an image copying operation is performed in the two-original feeding mode, while the stapling mode is canceled.

Figure 9:
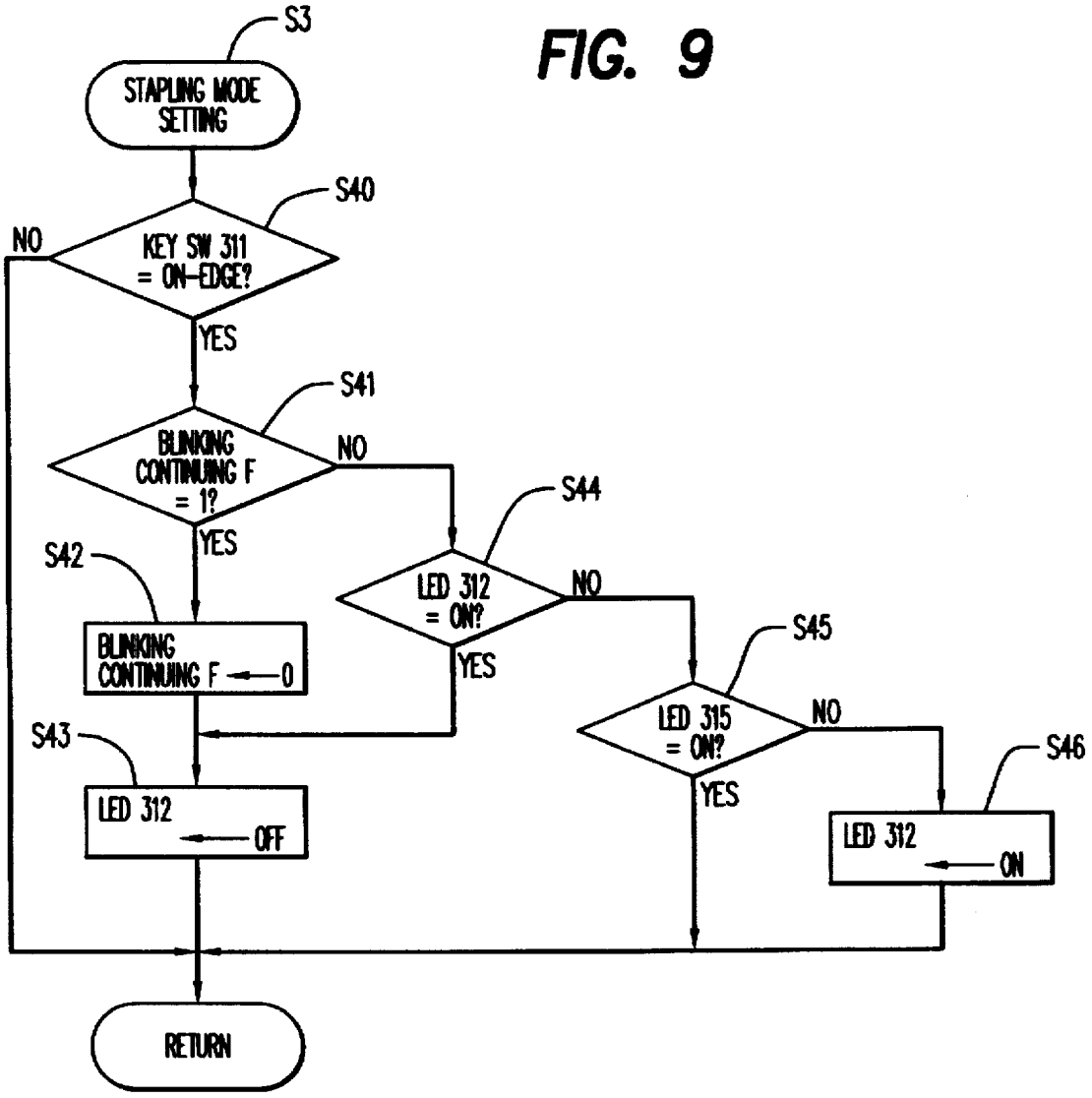
FIG. 9 is a flowchart showing a subroutine for selecting a stapling mode.

FIG. 9 shows a subroutine for setting the stapling mode, which is performed at step S3.

First, it is judged at step S40 whether the mode selection key switch 311 is on-edge. When the key switch 311 is not on-edge, this subroutine is completed. When the key 311 is on-edge, the processing goes to step S41, where it is judged whether the blinking continuing flag is "1". When the flag is "1", which means that the stapling mode has been selected inappropriately and that a warning has been indicated, the flag is reset to "0" at step S42, and the LED 312 is turned off to cancel the stapling mode at step S43. Then, this subroutine is completed.

On the other hand, when the blinking continuing flag is "0" ("NO" at step S41), it is judged at step S44 whether the LED 312 is on. When the LED 312 is on, at step S43 the LED 312 is turned off to cancel the stapling mode. When the LED 312 is off, it is judged at step S45 whether the LED 315 is on, that is, whether the two-original feeding mode is selected. When the LED 315 is on, this subroutine is completed to inhibit a selection of the stapling mode. When the LED 315 is off, at step S46 the LED 312 is turned on to select the stapling mode. Then, this subroutine is completed.

Figure 10:
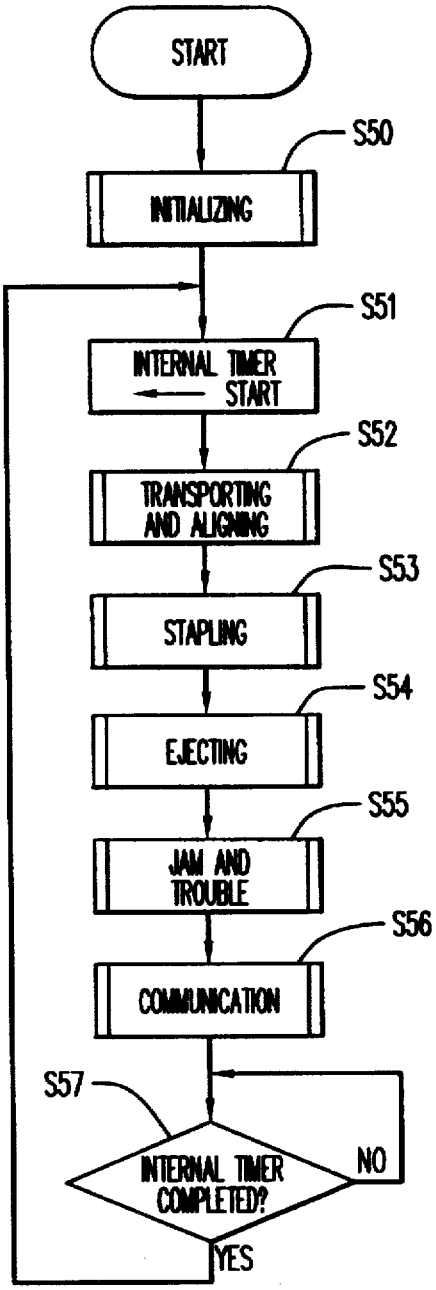
FIG. 10 is a flowchart showing a main routine of a microcomputer controlling a finisher unit.

FIG. 10 shows a main routine of the third CPU 350.

When a program is started, initial setting such as clearing the RAM are performed at Step S50, and an internal timer is started at step S51. The internal timer has the same function as the internal timer of the CPU 330. Subsequently the subroutines at Steps S52 through S56 are successively called. At step S56 data communication between the third CPU 350 and the first CPU 330 is performed, and after the internal timer runs out at Step S57, the CPU operation returns to Step S51.

At Step S52 copy sheets ejected from the copying machine 1000 are transported to the tray 80 or to the staple tray 90, and the copy sheets transported to the staple tray 90 are aligned in the stapling position. At Step S53 the aligned copy sheets are stapled by the stapler 130. At Step S54, the stapled copy sheets are ejected from the staple tray 90 into the sheet stack unit 160. At Step S55, such a trouble as a paper jam is detected, and necessary operations are performed for indicating a warning.

Figure 11:
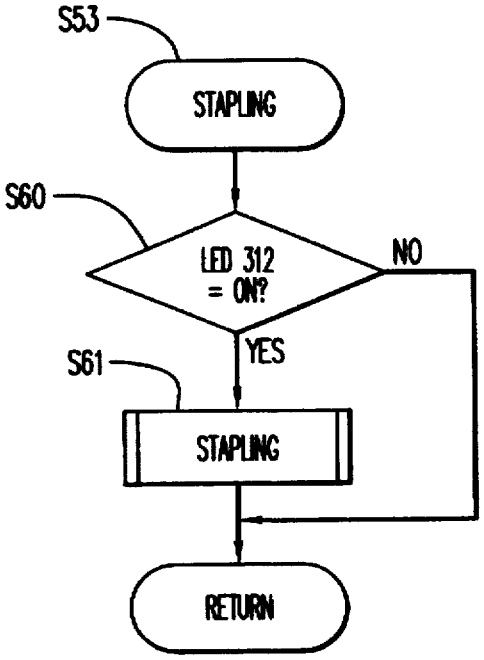
FIG. 11 is a flowchart showing a subroutine for stapling copy sheets.

FIG. 11 shows a subroutine for stapling copy sheets, which is performed at step S53.

First, it is judged at step S60 whether the LED 312 is on. In this moment, the judgment is performed by reading data on the on/off status of the LED 312 transmitted from the first CPU 330 to the third CPU 350. When the LED 312 is on, which means that the stapling mode is set, the stapler 130 is activated to staple the copy sheets at Step S61.

Although the present invention has been described in connection with the preferred embodiment thereof, it is to be noted that various changes and modifications are apparent to those who are skilled in the art. Such changes and modifications are to be understood as included within the scope of the present invention as defined by the appended claims, unless they depart therefrom.

In particular, the copying machine 1000, ADF 200, finisher unit 50 may have a variety of constructions and operations. They may be so designed that when the two-original feeding mode is selected and put in operation, the stapling mode is canceled, and further copy sheets stored in the staple tray 90 are ejected therefrom without being stapled.

What is claimed is:

1. A copying apparatus comprising:

means for feeding originals onto a platen glass, which is operated either in a two-original feeding mode where two originals are placed in a particular position on the platen glass side-by-side or in a one-original feeding mode where a single original is placed in a particular position on the platen glass;

means for copying the images of the originals fed onto the platen glass on copy sheets;

means for handling copy sheets on which images were copied by the copying means, which is operated either in a binding mode where copy sheets are collected and bound or in a non-binding mode where copy sheets are stacked without being bound;

first mode selecting means for selecting an operation mode of the original feeding means;

second mode selecting means for selecting an operation mode of the sheet handling means; and indication means for indicating that the selected operation mode of the sheet handling means is not compatible with a mode of the original feeding means selected by the first mode selecting means.

2. A copying apparatus as claimed in claim 1, wherein the indication means generates a warning indicating that the sheet handling means is not compatible with the two-original feeding mode in the binding mode when the two-original feeding mode is selected by the first mode selecting means after the binding mode was selected by the second mode selecting means.

3. A copying apparatus as claimed in claim 2, further comprising:

for starting a copying operation by the copying means; and control means for canceling the binding mode of the sheet handling means when the starting means is turned on although the warning has been generated by the indication means.

* * * * *

UNITED STATES PATENT AND TRADEMARK OFFICE

CERTIFICATE OF CORRECTION

PATENT NO. : 5,697,039

DATED : December 9, 1997

INVENTOR(S) : Kadotaro NISHIMORI, et al.

It is certified that error appears in the above-indentified patent and that said Letters Patent is hereby corrected as shown below:

In column 12, line 26, --means-- is inserted before "for".

Signed and Sealed this

Tenth Day of March, 1998

Bruce Lehman

*Attest:*

BRUCE LEHMAN

*Attesting Officer*

*Commissioner of Patents and Trademarks*